US012233922B2

(12) United States Patent
Tokuhira

(10) Patent No.: US 12,233,922 B2
(45) Date of Patent: Feb. 25, 2025

(54) TRAVEL CONDITION NETWORK INFORMATION GENERATION SYSTEM, TRAVEL CONDITION NETWORK INFORMATION GENERATION APPARATUS, AND TRAVEL CONDITION NETWORK INFORMATION GENERATION METHOD

(71) Applicant: Kawasaki Jukogyo Kabushiki Kaisha, Kobe (JP)

(72) Inventor: Masatsune Tokuhira, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 651 days.

(21) Appl. No.: 17/309,842

(22) PCT Filed: Dec. 28, 2018

(86) PCT No.: PCT/JP2018/048513
§ 371 (c)(1),
(2) Date: Jun. 23, 2021

(87) PCT Pub. No.: WO2020/136882
PCT Pub. Date: Jul. 2, 2020

(65) Prior Publication Data

US 2022/0024502 A1 Jan. 27, 2022

(51) Int. Cl.
*B61L 25/00* (2006.01)

(52) U.S. Cl.
CPC ..... *B61L 25/00* (2013.01)

(58) Field of Classification Search
None
See application file for complete search history.

(56) References Cited

U.S. PATENT DOCUMENTS

| | | | | |
|---|---|---|---|---|
| 2010/0023190 | A1* | 1/2010 | Kumar | B61L 27/40 701/20 |
| 2018/0222504 | A1* | 8/2018 | Birch | B61L 3/008 |
| 2020/0290659 | A1* | 9/2020 | Ersch | B61L 27/70 |

FOREIGN PATENT DOCUMENTS

| | | | |
|---|---|---|---|
| JP | H10-181603 | A1 | 7/1998 |
| JP | 2005-041431 | A1 | 2/2005 |
| JP | 2009-150796 | A | 7/2009 |
| JP | 2016-037070 | A1 | 3/2016 |
| JP | 2017-097088 | A | 6/2017 |

OTHER PUBLICATIONS

International Search Report and Written Opinion (Application No. PCT/JP2018/048513) dated Apr. 2, 2019.
Japanese Office Action (with English translation) dated Jan. 10, 2023 (Application No. 2020-562278).

* cited by examiner

*Primary Examiner* — Tamara L Weber
(74) *Attorney, Agent, or Firm* — BURR PATENT LAW, PLLC

(57) ABSTRACT

A travel condition network information generation system includes: a travel condition output unit provided on the transport, and outputting a piece of travel condition data responsive to a travel condition of the transport; and a controller generating, based on a plurality of pieces of travel condition data, a plurality of pieces of divided travel condition information responsive to divided travel paths obtained by dividing a plurality of travel paths, and generating, based on the plurality of pieces of divided travel condition information, the travel condition network information corresponding to the travel path network of the transport.

12 Claims, 7 Drawing Sheets

TRAVEL CONDITION NETWORK INFORMATION GENERATION SYSTEM, TRAVEL CONDITION NETWORK INFORMATION GENERATION APPARATUS, AND TRAVEL CONDITION NETWORK INFORMATION GENERATION METHOD

TECHNICAL FIELD

The present invention relates to technology of generating travel condition network information of a transport, such as a railroad.

BACKGROUND ART

Patent Document 1 discloses generation of reference data based on known data on a track on which a train runs and use of the reference data for calculation of line information of a train location from a positioning result based on a received satellite signal.

Patent Document 2 discloses input of a track circuit object, a point object, and a connection wire object by an operator through an input means and analysis of an attribute of each of the track circuit object and the point object and a connection relationship between the track circuit object and the point object represented by the connection wire object for generation of track wiring XML data representing track wiring.

PRIOR ART DOCUMENTS

Patent Documents

Patent Document 1: Japanese Patent Application Laid-Open No. 2016-037070

Patent Document 2: Japanese Patent Application Laid-Open No. 2005-041431

SUMMARY

Problem to be Solved by the Invention

In Patent Document 1, it is necessary to have data on the track on which the train runs as the known information.

In technology disclosed in Patent Document 2, it is necessary for the operator to acquire information on a track on which a train runs to input the track circuit object, the point object, and the connection wire object through the input means.

It is thus an object of the present invention to enable easy generation of travel condition network information corresponding to a travel path network of a transport.

Means to Solve the Problem

To solve the above-mentioned problem, a travel condition network information generation system includes: a travel condition output unit provided on a transport, and outputting a piece of travel condition data responsive to a travel condition of the transport; and a controller generating, based on a plurality of pieces of travel condition data, a plurality of pieces of divided travel condition information responsive to divided travel paths obtained by dividing a plurality of travel paths, and generating, based on the plurality of pieces of divided travel condition information, travel condition network information corresponding to a travel path network of the transport.

To solve the above-mentioned problem, a travel condition network information generation apparatus includes: a travel condition data input unit receiving a plurality of pieces of travel condition data responsive to a travel condition of a transport; and a controller generating, based on the plurality of pieces of travel condition data, a plurality of pieces of divided travel condition information responsive to divided travel paths obtained by dividing a plurality of travel paths, and generating, based on the plurality of pieces of divided travel condition information, travel condition network information corresponding to a travel path network of the transport.

To solve the above-mentioned problem, a travel condition network information generation method includes: (a) outputting a plurality of pieces of travel condition data responsive to a travel condition of a transport; (b) generating, based on the plurality of pieces of travel condition data, a plurality of pieces of divided travel condition information responsive to divided travel paths obtained by dividing a plurality of travel paths; and (c) generating, based on the plurality of pieces of divided travel condition information, travel condition network information corresponding to a travel path network of the transport.

Effects of the Invention

According to the travel condition network information generation system, the travel condition network information generation apparatus, and the travel condition network information generation method, the plurality of pieces of divided travel condition information responsive to the divided travel paths obtained by dividing the plurality of travel paths can be generated based on the pieces of travel condition data of the transport, and the travel condition network information corresponding to the travel path network can easily be generated based on the plurality of pieces of divided travel condition information.

DESCRIPTION OF EMBODIMENT

Figure 1:
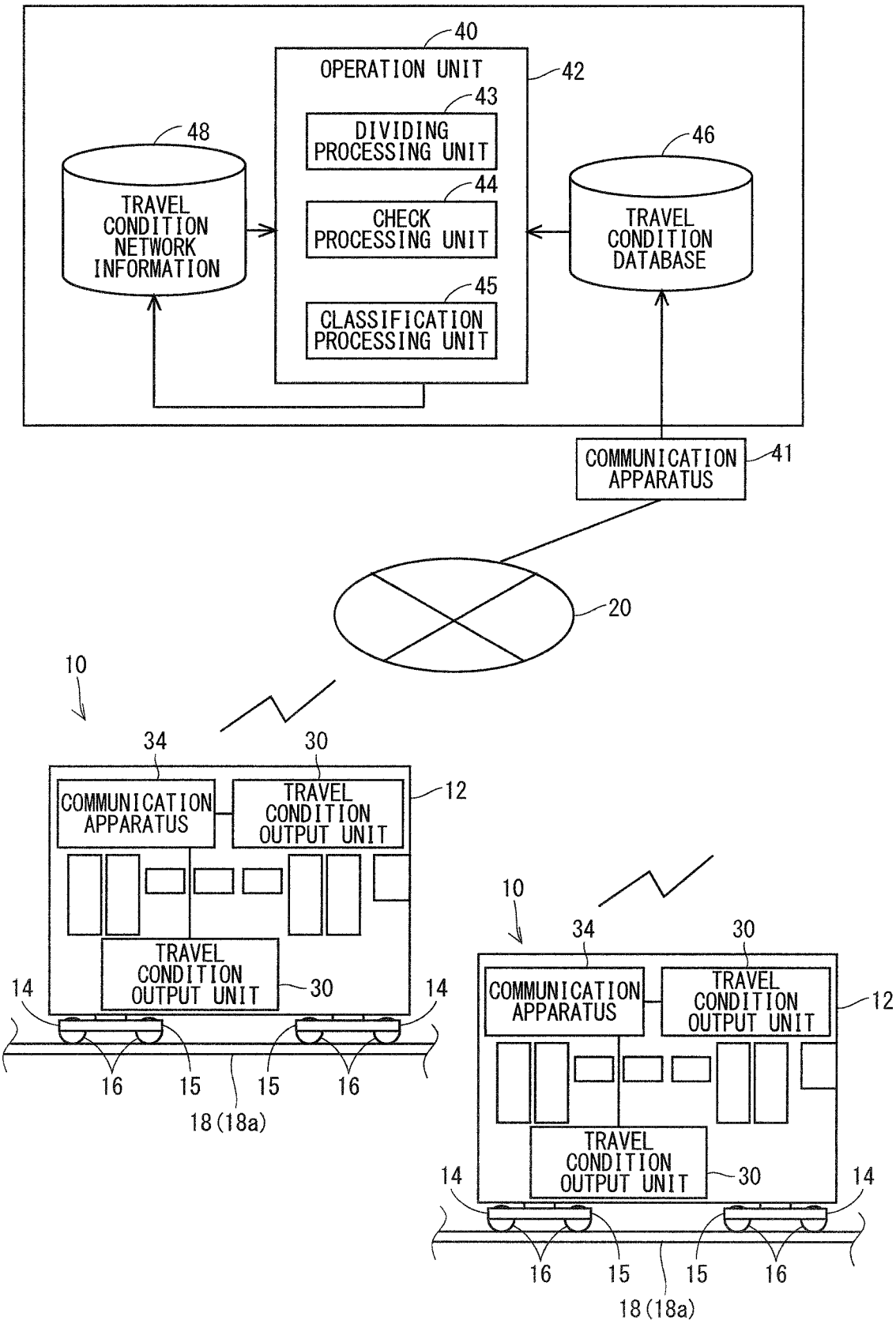
FIG. 1 is a block diagram showing a travel condition network information generation system according to an embodiment.

A travel condition network information generation system, a travel condition network information generation apparatus, and a travel condition network information generation method according to an embodiment will be described below. FIG. 1 is a block diagram showing the travel condition network information generation system. An example in which the above-mentioned system, apparatus, and method are applied to a railroad car as a kind of transport will be described herein. A transport 10 is a machine for transporting at least one of a person and an object.

The travel condition network information generation system includes a travel condition output unit 30 and a controller 40.

A plurality of travel condition output units 30 are herein provided on respective transports 10. The plurality of transports 10 are herein railroad cars 10. The plurality of railroad cars 10 are cars running on a railroad path network 19 (see FIG. 4) as a travel path network. The plurality of railroad cars 10 run along any lines of the railroad path network 19. Each of the railroad cars 10 may run along only a fixed line or along a different line each time. The plurality of railroad cars 10 as a whole may run on the railroad path network 19 as a whole. The travel condition output unit 30 may be provided on only one transport 10. If the one transport 10 on which the travel condition output unit 30 is provided runs along different paths of the railroad path network 19, and the travel condition output unit 30 outputs data a plurality of times for respective paths, pieces of travel condition data along the different paths can be acquired using the travel condition output unit 30 provided on the one transport 10. That is to say, it is only necessary to acquire a plurality of pieces of travel condition data along different paths regardless of whether the number of travel condition output units 30 is one or more and whether the number of transports 10 is one or more.

Each of the railroad cars 10 runs on a track 18. The track 18 is a linear road guiding the railroad car along a path. The track 18 herein includes two rails 18*a*. The two rails 18*a* are laid in parallel with each other over the ground through ties and the like. The track may be a track including only one rail guiding the railroad car, as in monorails. The track may be provided at a location above the ground using a viaduct and the like. The track may be provided in a tunnel dug underground.

Each of the railroad cars 10 includes a body 12 and trucks 14. Each of the trucks 14 includes a truck frame 15 and a plurality of wheels 16. The plurality of wheels 16 are rotatably supported by the truck frame 15 through an axle on the left and right sides of the truck frame 15. A portion supporting the axle is sometimes referred to as an axle box. Left and right herein refer to left and right as viewed in a direction of travel from within each of the railroad cars 10. The left and right wheels 16 run on the track 18 while being guided by the two rails 18*a* of the track 18. Each of the trucks 14 is supported at the bottom of the body 12. The trucks 14 run on the track 18, so that the railroad car 10 including the body 12 runs along the track 18. The railroad car 10 is only required to be a car running on the track 18, and may be any of a locomotive and a freight car of a freight train and a locomotive and a passenger car of a passenger train. The freight car or the passenger car may be a trailing car towed by the locomotive, or may be a powered car having power. The locomotive may be an electric locomotive, or may be an internal combustion locomotive, such as a diesel locomotive.

At least one travel condition output unit 30 is provided on the railroad car 10. FIG. 1 shows an example in which two travel condition output units 30 are provided on the railroad car 10. A single travel condition output unit 30 may be provided on the railroad car 10, and three or more travel condition output units 30 may be provided on the railroad car 10.

Each of the travel condition output units 30 outputs a piece of travel condition data responsive to a travel condition of the railroad car 10.

As one example of the travel condition output unit 30, a unit outputting location information on the location of the railroad car 10 is envisioned. More specifically, a global navigation satellite system (GNSS) receiver is envisioned as the travel condition output unit 30.

As another example of the travel condition output unit 30, a unit outputting at least one of information on behavior of the railroad car 10 and information on a path during travel is envisioned. The former is a unit outputting information on physical behavior of the railroad car 10 itself, and a wheel speed sensor detecting the speed of the railroad car 10, an acceleration sensor detecting the acceleration in the direction of travel of the railroad car 10, and an acceleration sensor detecting the acceleration in the vertical direction and the horizontal direction of the railroad car 10 are envisioned, for example.

The latter is a unit outputting information responsive to the path during travel, herein, a surface condition of the rails 18*a* or a relative relationship between the two rails 18*a*. An acceleration sensor or a gyroscopic sensor outputting a signal responsive to displacement of the track is envisioned, for example. That is to say, if the rails 18*a* as the path are displaced, the displacement is transferred to the railroad car 10 through the wheels 16 running on the rails 18*a*. A signal indicating detection of the physical behavior (e.g., vibration) of the railroad car 10 based on the displacement of the rails 18*a* can thus be used as the information on the path. Such an acceleration sensor or a gyroscopic sensor can be grasped to output the information on the behavior of the railroad car 10, and can also be grasped to output the information on the path during travel. The acceleration sensor may be provided on the body 12, the truck 14, and the axle box.

As another example of the latter, an optical location sensor, an ultrasonic location sensor, an eddy-current displacement sensor, and the like may be provided on the railroad car as the travel condition output unit 30, displacement of the track may be detected using the sensor, and a result of detection may be output as a signal responsive to the path. As yet another example of the latter, an imaging unit capturing an image of the pair of rails 18*a* may be provided on the railroad car 10 as the travel condition output unit, the distance between the rails 18*a* may be detected using the imaging unit through image recognition of the pair of rails 18*a*, and the distance between the rails 18*a* may be output as the signal responsive to the path.

In each of the railroad cars 10, the travel condition output unit 30 is connected to a communication apparatus 34. The communication apparatus 34 can communicate with the controller 40, which will be described below, via a communication network 20. The piece of travel condition data output from the travel condition output unit 30 is transmitted to the controller 40 via the communication apparatus 34 and the communication network 20. Processing performed by the controller 40 may be performed as batch processing after pieces of travel condition data from the travel condition output unit 30 are accumulated in a first storage 46, which will be described below. In this case, the travel condition output unit 30 and the communication apparatus 34 are not required to be communicatively connected to each other in the stage in which the controller 40 performs the processing. The controller 40 may perform the processing each time a piece of travel condition data is transmitted from the travel condition output unit 30. In this case, travel condition network information having immediacy can be generated.

The controller 40 is configured by a computer including a central processing unit (CPU), read only memory (ROM), random access memory (RAM), and the like. The controller 40 and a travel condition data input unit as an interface receiving a signal from the travel condition output unit 30 constitute the network information generation apparatus. The computer includes a storage configured by rewritable flash memory, a magnetic storage device, or the like. A program for causing the computer to function as the controller performing the processing described below is stored in the storage. The CPU performs operations according to procedures described in the program, so that the computer performs processing of generating, based on pieces of travel condition data from the respective railroad cars 10, a plurality of pieces of divided travel condition information responsive to divided travel paths obtained by dividing travel paths of the plurality of railroad cars 10, and generating, based on the plurality of pieces of divided travel condition information, the travel condition network information corresponding to the railroad path network 19.

The controller 40 includes an operation unit 42 configured by the CPU, the first storage 46, and a second storage 48.

The controller 40 is connected to a communication apparatus 41 as the travel condition data input unit. The controller 40 can communicate with the plurality of railroad cars 10 via the communication apparatus 41, the communication network 20, and communication apparatuses 34. The communication network 20 may be a wired or wireless communication network, or may be a combination of the wired and wireless communication networks. The communication network 20 may be a public communication network, or may be a communication network using a dedicated line.

The operation unit 42 includes a dividing processing unit 43, a check processing unit 44, and a classification processing unit 45. The dividing processing unit 43 divides pieces of travel condition data to generate a plurality of pieces of divided travel condition information. The check processing unit 44 checks the plurality of pieces of divided travel condition information against one another. The classification processing unit 45 classifies, in accordance with a result of the check, the plurality of pieces of divided travel condition information according to paths.

The first storage 46 is configured by rewritable flash memory, a magnetic storage device, or the like, and accumulates a plurality of pieces of travel condition data transmitted from the plurality of railroad cars 10 as a travel condition database.

The second storage 48 is configured by rewritable flash memory, a magnetic storage device, or the like, and stores the travel condition network information generated and updated based on the plurality of pieces of travel condition data.

The first storage 46 and the second storage 48 may be configured as separate devices, or may be configured as the same device. A database of at least one of them may be built in a server different from the controller 40.

Figure 2:
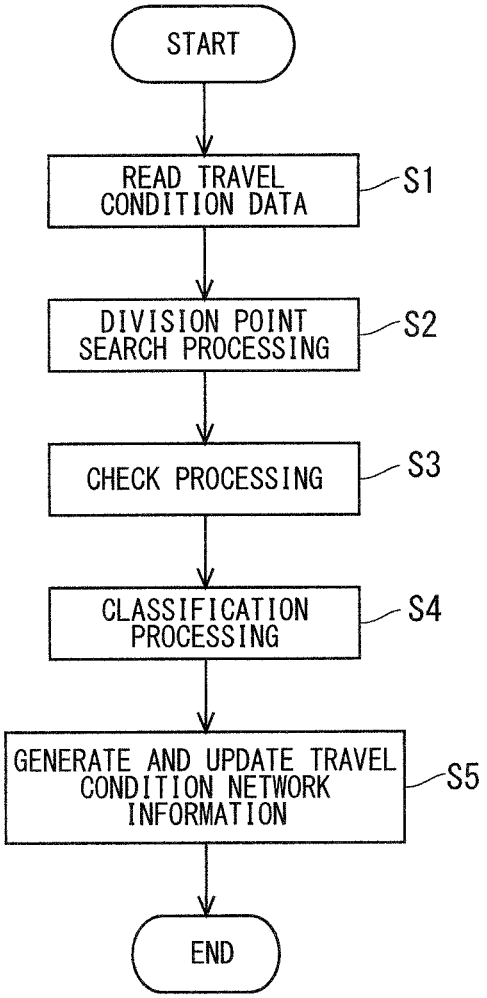
FIG. 2 is a flowchart showing one example of processing performed by a controller.

FIG. 2 is a flowchart showing one example of processing performed by the controller 40.

Assume that the pieces of travel condition data from the plurality of railroad cars 10 are accumulated as the travel condition database in the first storage 46.

In step S1, the controller 40 reads the plurality of pieces of travel condition data from the first storage 46.

In step S2, the controller 40 performs division point search processing on the pieces of travel condition data. In searching for division points, a machine-learned inferential model may be used to search the pieces of travel condition data for the division points, or a condition for the division points may be defined with respect to the pieces of travel condition data and operation to determine whether the definition is met may be performed to search for the division points.

Figure 3:
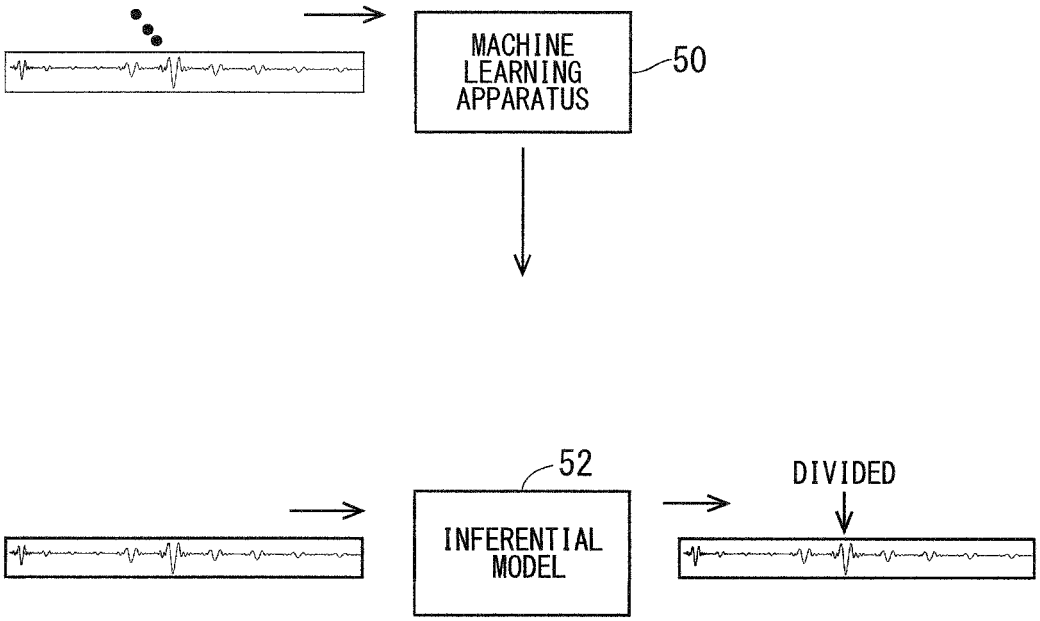
FIG. 3 shows one example of an inferential model.

That is to say, as shown in FIG. 3, for a machine learning apparatus 50, features suitable for learning of dividing are extracted from pieces of travel condition data with changes at division points. It is herein envisioned that the division points are locations of junctions of the paths. The paths may be divided at a location other than the junctions. At the junctions, joints of the rails 18*a* are present, and, due to the presence of the joints, the railroad cars 10 rock, so that features representing the information on the path during travel, such as the acceleration detected by the acceleration sensor outputting the signal responsive to the displacement of the track and data on the displacement of the track, may be used as the features. The speed, the acceleration, and the like of the railroad cars 10 may also be used as the features as the railroad cars 10 slew down at the junctions. A inferential model 52 suitable for inferring the junctions is generated based on input learning data. The division points can be extracted by applying the inferential model 52 to each of the pieces of travel condition data. As a classifier, various classifiers applicable for pattern recognition, such as a neural network, a support-vector machine (SVM), and a hidden Markov model (HMM), can be used.

Learning may be supervised learning based on data designating junctions separately prepared in advance. Alternatively, learning may be unsupervised learning of performing clustering to distinguish between locations of junctions and locations of non-junctions from pieces of travel condition data including pieces of data corresponding to a plurality of junctions, and the like.

As the processing of defining the condition for the division points with respect to the pieces of travel condition data and determining whether the definition is met to search for the division points, for example, waveforms of features (e.g., acceleration waveforms) at the division points may be defined, and cross-correlation operation between the waveforms and waveforms of features (e.g., acceleration waveforms) of the pieces of travel condition data may be performed to set the division points when a condition in a predetermined similarity range is met.

Alternatively, the imaging unit provided on the railroad car 10 may capture an image of the rails 18*a*, and breaks in the rails 18*a* may be recognized from the captured image to determine locations of junctions, that is, division locations.

The pieces of travel condition data from the respective railroad cars 10 may be compared with one another to search for a location where they match and a location where they do not match, and a point between the location where they match and the location where they do not match may be set as a division point.

By searching the pieces of travel condition data for the division points, and performing separation at the division points, the plurality of pieces of divided travel condition information responsive to the divided travel paths obtained by dividing the plurality of travel paths of the railroad cars 10 can be generated.

Nodes at opposite ends (a start point and an end point) of each of the pieces of divided travel condition information are caused to hold connection information on the nodes connected to each other, so that the pieces of divided travel condition information can be rebuilt as the travel condition network information later.

In next step S3, the controller 40 performs check processing. The check processing is processing of checking the pieces of divided travel condition information against one another to check whether they match. In the check, a machine-learned inferential model may be used to check each of the pieces of divided travel condition information obtained by dividing the pieces of travel condition data against the other pieces of divided travel condition information, or a condition for evaluating a degree of matching of the pieces of divided travel condition information may be defined, and the check may be performed by determining whether the definition is met.

That is to say, as in FIG. 3, for the machine learning apparatus, features suitable for the check of the pieces of divided travel condition information against one another are extracted. The pieces of divided travel condition information are dependent on locations where the railroad cars 10 run and the distances by which the railroad cars 10 run, so that location information, such as latitude and longitude, (string data of a latitude path), distance information, and the like may be used as the features. The pieces of divided travel condition information are also dependent on states of the paths, so that data responsive to the state of the track, such as information on displacement of the track (e.g., level displacement of the rails, alignment displacement of the rails, and gage displacement of left and right rails) and the acceleration detected by the acceleration sensor outputting the signal responsive to the displacement of the track, may also be used as the features. The speed, the acceleration, and the like of the railroad cars 10 may also be used as the features as the railroad cars 10 are considered to run at similar speeds with similar accelerations on the same path. The number of features may be one or more.

The inferential model suitable for the check of the pieces of divided travel condition information against one another is generated based on input learning data. The pieces of divided travel condition information can be checked against one another by applying each of the pieces of divided travel condition information to the inferential model. As the classifier, various classifiers applicable for pattern recognition, such as the neural network, the support-vector machine (SVM), and the hidden Markov model (HMM), can be used. In the HMM, the features are extracted from the pieces of travel condition data, and learning can be performed using learning data obtained by labelling the extracted features with the division points manually or using the machine-learned inferential model, for example. In the HMM, learning can be performed by estimating parameters maximizing likelihood of the pieces of travel condition data as the learning data using initial state probability, state transition probability, and output probability of data corresponding to each of the pieces of divided travel condition information as parameters. In the HMM after learning, the check is performed considering the state transition probability and the like in data corresponding to each of the pieces of travel condition data as input, allowing for high check accuracy.

Learning may be supervised learning based on pieces of divided travel condition information which are separately prepared in advance and to which respective pieces of path identification information have been added, or may be unsupervised learning of clustering the plurality of pieces of divided travel condition information.

As processing of defining the condition for evaluating the degree of matching of the pieces of divided travel condition information, and performing the check by determining whether the definition is met, cross-correlation operation among waveforms (e.g., acceleration waveforms) included in the respective pieces of divided travel condition information may be performed to determine that any pieces of divided travel condition information correspond to paths matching each other when a condition in a predetermined similarity range is met and that any pieces of divided travel condition information correspond to different paths when the condition is not met, for example.

In the check, it is required to check the pieces of divided travel condition information against one another while following a plurality of travel paths. This enables the check with high accuracy.

When the pieces of travel condition data from the respective railroad cars 10 each include the location information, whether paths correspond to each other may be determined from similarity in location information.

In next step S4, based on the plurality of pieces of divided travel condition information as checked, the plurality of pieces of divided travel condition information are classified into units obtained by dividing the railroad path network of the plurality of railroad cars 10 at the division points. When a plurality of pieces of divided travel condition information belong to any of the division units, the plurality of pieces of divided travel condition information are integrated into a single piece of data. In integration, the plurality of pieces of divided travel condition information may be equalized, or any one of the plurality of pieces of divided travel condition information may represent the plurality of pieces of divided travel condition information, for example.

In next step S5, nodes of the classified pieces of divided travel condition information are linked with reference to node information at the opposite ends of each of the pieces of divided travel condition information to generate the travel condition network information corresponding to the railroad path network of the plurality of railroad cars 10. The generated travel condition network information is stored in the second storage 48. When the travel condition network information generated in the past is stored in the second storage 48, the travel condition network information is updated.

The above-mentioned example is an example in which the division point search processing in the step S2, the check processing in the step S3, and the classification processing in the step S4 are sequentially performed, but two or more of them may be performed together. For example, the check processing in the step S3 and the classification processing in the step S4 may be performed together by checking and classifying the plurality of pieces of divided travel condition information into units obtained by dividing the railroad path network of the plurality of railroad cars 10 at the division points using a classifier to which the HMM is applied. The division point search processing, the check processing, and the classification processing on the pieces of travel condition data may simultaneously be performed together using a classifier to which the HMM having learned pieces of travel condition data with the division points is applied. Each of the above-mentioned division point search processing, the check processing, and the classification processing or two or more of them performed together may be performed using a classifier to which the neural network or the SVM is applied or using the HMM or a Gaussian mixture model (GMM)-HMM into which the neural network or the SVM is incorporated.

Figure 4:
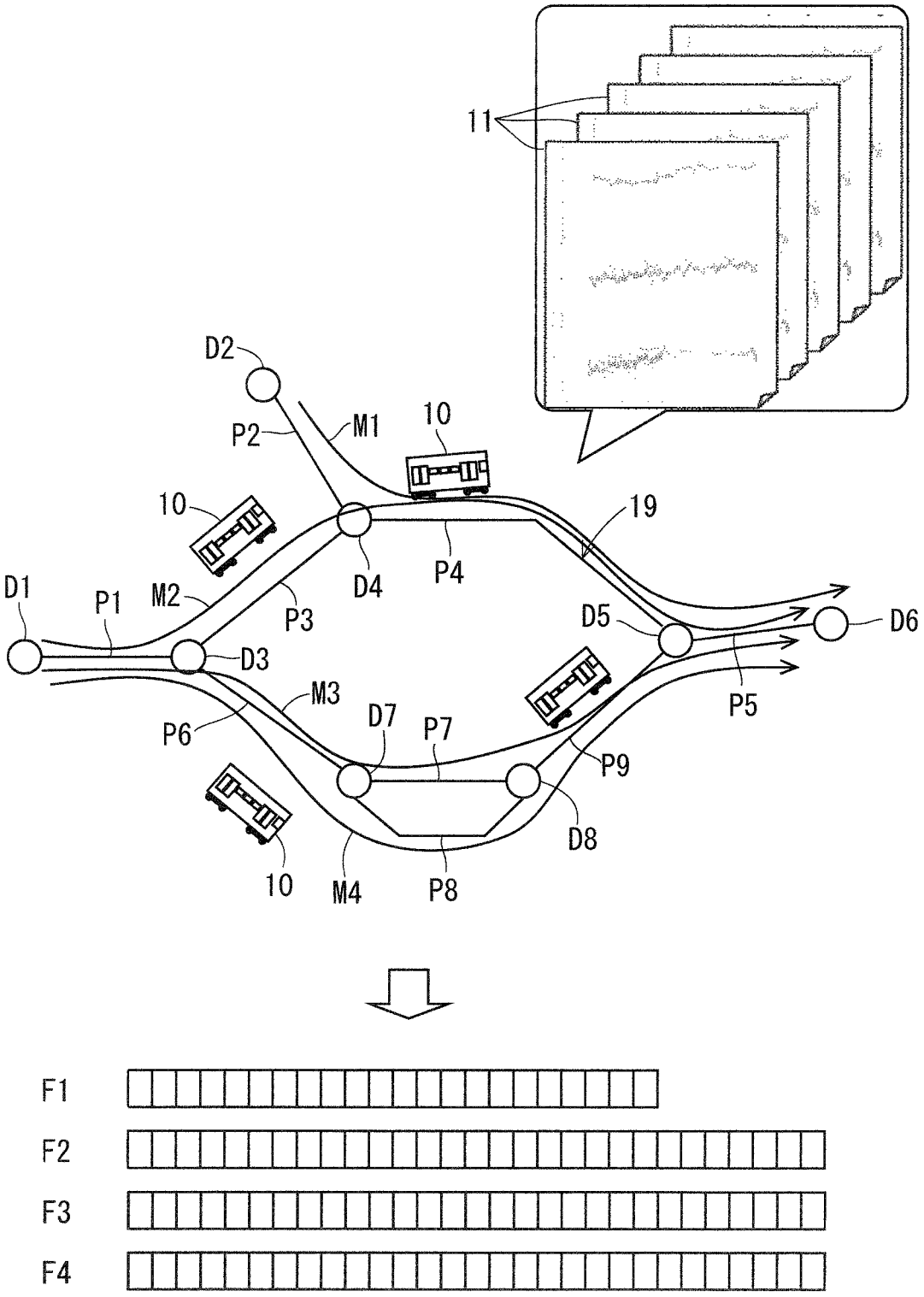
FIG. 4 illustrates an example of processing of data.
Figure 5:
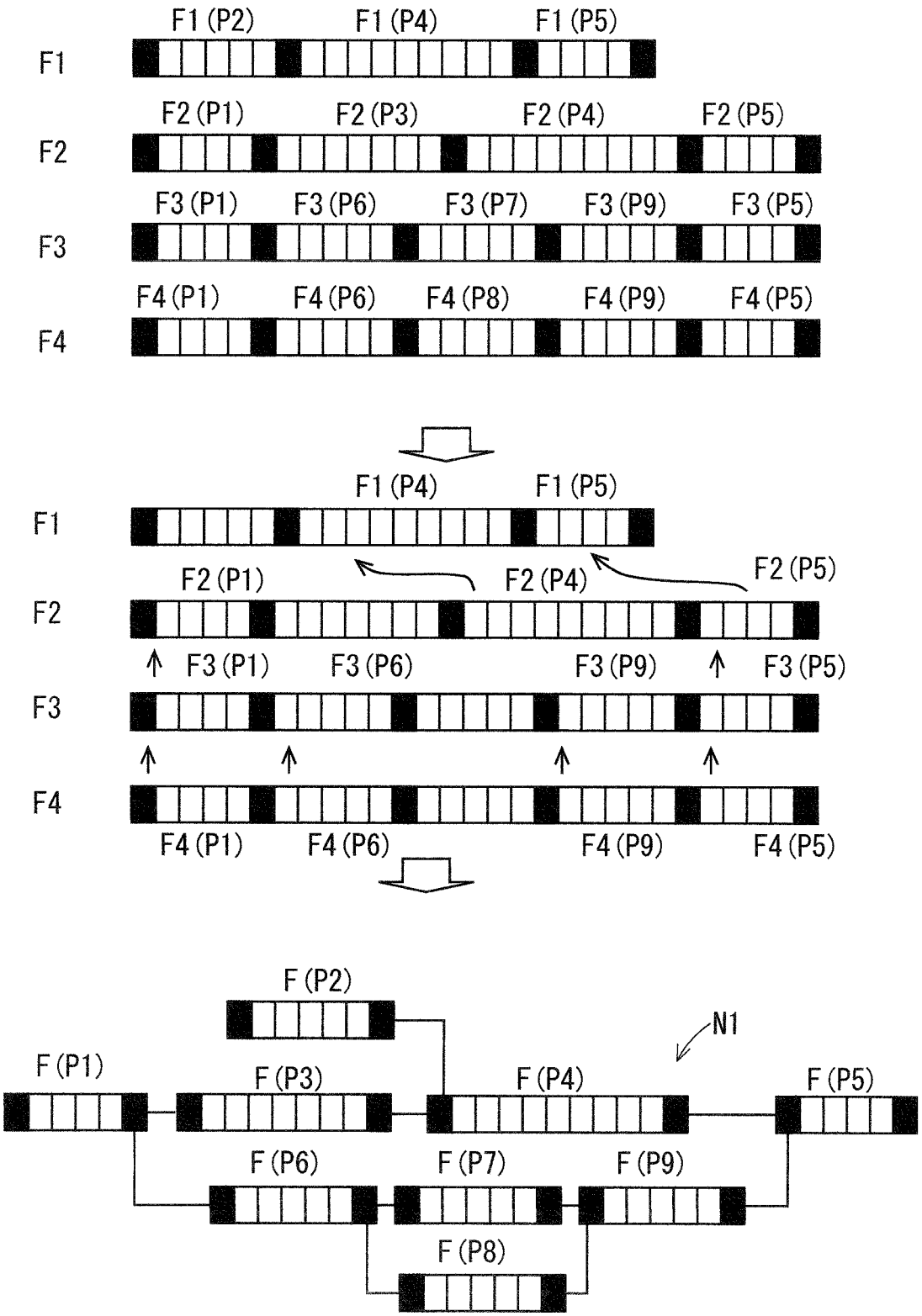
FIG. 5 illustrates an example of processing of data.

FIGS. 4 and 5 illustrate an example of processing of data. In the example illustrated in FIGS. 4 and 5, description is made based on the assumption that each of the pieces of travel condition data does not include the location information.

Assume that the plurality of railroad cars 10 run on the railroad path network 19 in FIG. 4. The railroad path network 19 has nodes D1, D2, D3, D4, D5, D6, D7, and D8 to each be an origin point, a start point, or a division point, and has a network structure in which the nodes are connected through divided paths P1, P2, P3, P4, P5, P6, P7, P8, and P9.

Assume that the plurality of railroad cars 10 run on the above-mentioned railroad path network 19. A travel path M1 of a first one of the railroad cars 10 is a path through the divided paths P2, P4, and P5. A travel path M2 of a second one of the railroad cars 10 is a path through the divided paths P1, P3, P4 and P5. A travel path M3 of a third one of the railroad cars 10 is a path through the divided paths P1, P6, P7, P9 and P5. A travel path M3 of a fourth one of the railroad cars 10 is a path through the divided paths P1, P6, P8, P9 and P5. The divided travel paths are obtained by dividing the travel paths of the railroad cars 10 into units of the divided paths.

Pieces of travel condition data 11 are output from the respective railroad cars 10 running on the railroad path network 19, and are accumulated in the first storage 46.

Assume that the pieces of travel condition data 11 output from the respective railroad cars 10 are accumulated as temporally discrete pieces of data F1, F2, F3, and F4, for example. Each of the pieces of data F1, F2, F3, and F4 includes at least one of the information on the behavior of the railroad car 10 or the information on the path during travel, for example.

When the division point search processing in the step S3 is performed, the pieces of data F1, F2, F3, and F4 become pieces of data as illustrated in FIG. 5. The division points are blackened in FIG. 5. The pieces of divided travel condition information obtained by dividing the pieces of data F1, F2, F3, and F4 at the division points are sometimes shown by the reference signs F1, F2, F3, and F4 to which reference signs indicating the divided paths corresponding thereto in parentheses have been added. For example, when the piece of data F1 is divided at the division points, a piece of divided travel condition information corresponding to the divided path P3 is a piece of divided travel condition information F1(P3).

When the check processing in the step S4 is performed, it is determined that a piece of divided travel condition information F1(P4) and a piece of divided travel condition information F2(P4) are the same, and a piece of divided travel condition information F1(P5), a piece of divided travel condition information F2(P5), a piece of divided travel condition information F3(P5), and a piece of divided travel condition information F4(P5) are the same, for example.

The classification processing is performed in the step S5, and pieces of divided travel condition information belonging to the same class are integrated into a single piece of divided travel condition information. In the step S6, the nodes of the pieces of divided travel condition information are linked based on the node information at the opposite ends of each of the pieces of divided travel condition information to generate travel condition network information N1. Pieces of divided travel condition information integrated after the check and classification are shown in FIG. 5 by a reference sign F to which a reference sign indicating a corresponding divided path in parentheses has been added.

The generated travel condition network information N1 is network information in which the plurality of pieces of divided travel condition information are connected to correspond to the railroad path network 19.

The travel condition network information may be information to which a graph theoretic weighted graph, that is, time information of the pieces of divided travel condition information between the division points has been added.

Figure 6:
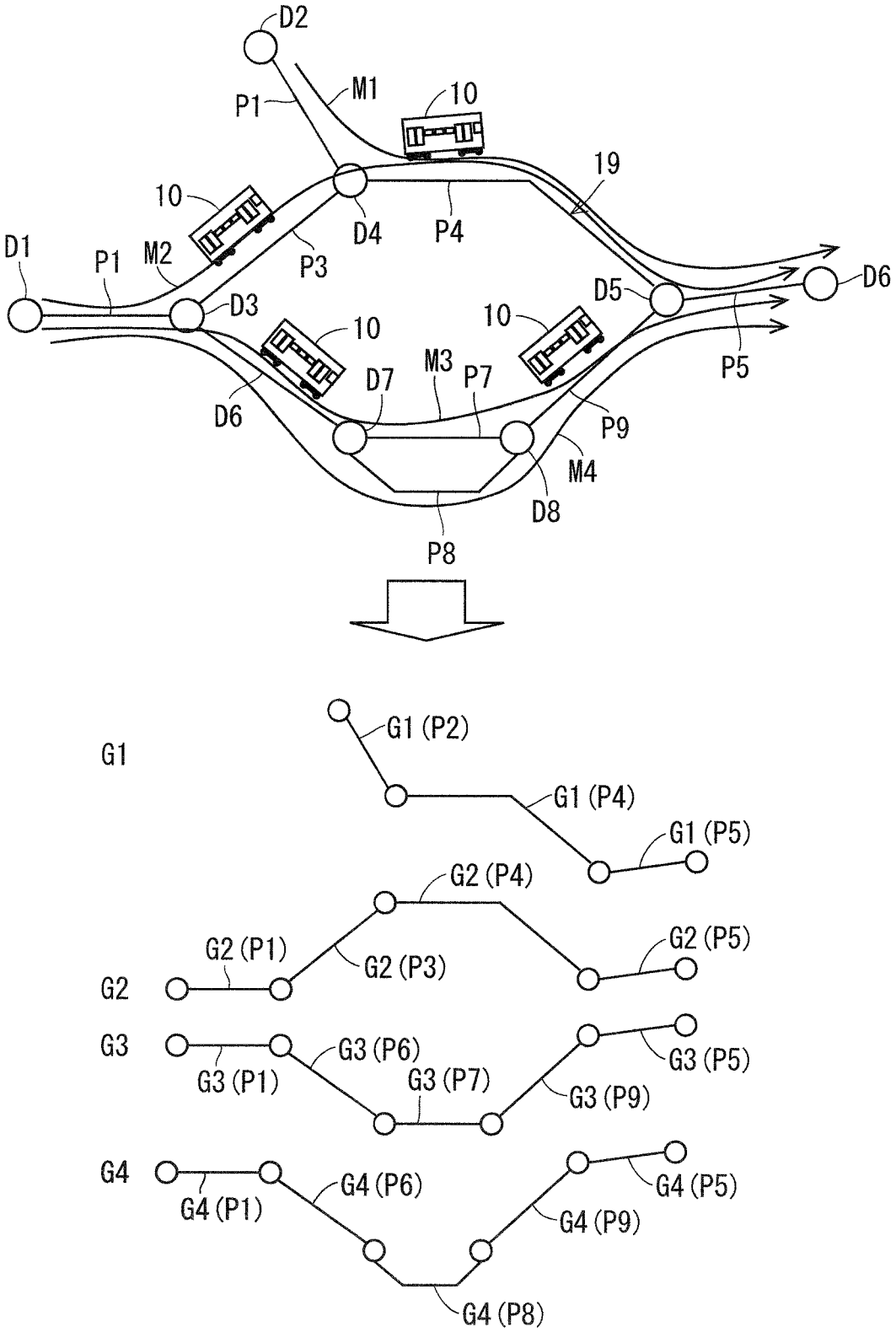
FIG. 6 illustrates another example of processing of data.
Figure 7:
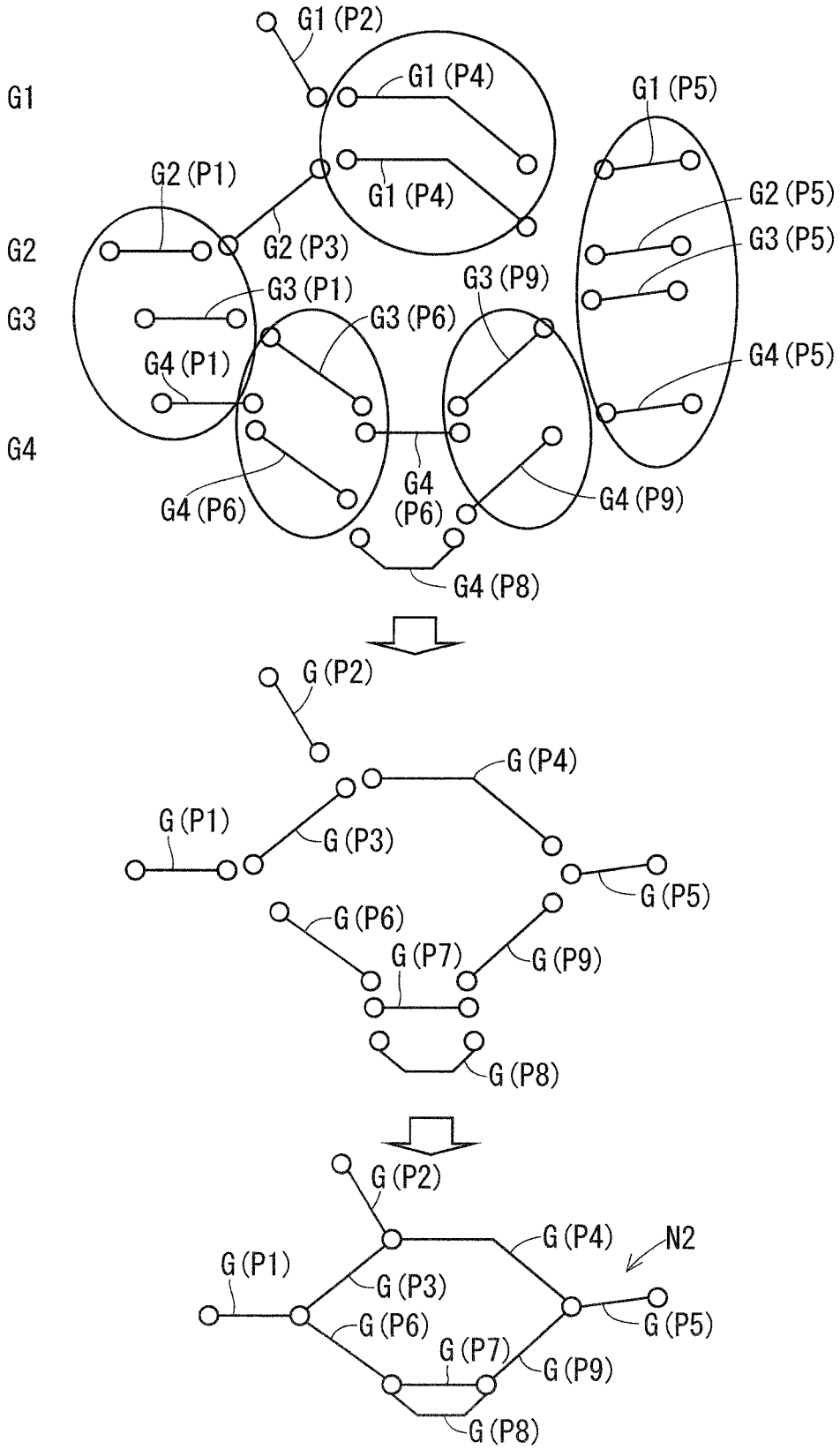
FIG. 7 illustrates the other example of processing of data.

FIGS. 6 and 7 illustrate another example of processing of data. In the example illustrated in FIGS. 6 and 7, description is made based on the assumption that each of the pieces of travel condition data includes the location information.

Assume that the plurality of railroad cars 10 run on the railroad path network 19 in FIG. 6 as in FIG. 4.

Pieces of travel condition data are output from the respective railroad cars 10 running on the railroad path network 19, and are accumulated in the first storage 46. Assume that the pieces of travel condition data from the respective railroad cars 10 each including the location information are accumulated as temporally discrete pieces of location data G1, G2, G3, and G4, for example. The pieces of location data G1, G2, G3, and G4 are pieces of data each including horizontal alignment. The pieces of location data G1, G2, G3, and G4 are pieces of data obtained by arranging latitudes and longitudes indicating the locations of the railroad cars 10 along a time axis, for example.

When the division point search processing in the step S3 is performed, the pieces of data G1, G2, G3, and G4 become pieces of data as illustrated in FIG. 7. The pieces of divided travel condition information obtained by dividing the pieces of data G1, G2, G3, and G4 at the division points are sometimes shown by the pieces of data G1, G2, G3, and G4 to which reference signs indicating the divided paths corresponding thereto in parentheses have been added. For example, when the piece of data G1 is divided at the division points, a piece of divided travel condition information corresponding to the divided path P3 is a piece of divided travel condition information G1(P3). The pieces of divided travel condition information are pieces of data each including horizontal alignment.

When the check processing in the step S4 is performed, it is determined that a piece of divided travel condition information G1(P4) and a piece of divided travel condition information G2(P4) are the same, a piece of divided travel condition information G1(P5), a piece of divided travel condition information G2(P5), a piece of divided travel condition information G3(P5), and a piece of divided travel condition information G4(P5) are the same, for example.

The classification processing is performed in the step S5, and pieces of divided travel condition information are integrated into a single piece of divided travel condition information for each class. In the step S6, the nodes of the pieces of divided travel condition information are linked based on the node information at the opposite ends of each of the pieces of divided travel condition information to generate travel condition network information N2. Integrated pieces of divided travel condition information are shown in FIG. 7 by a reference sign G to which a reference sign indicating a corresponding divided path in parentheses has been added.

The generated travel condition network information is network information in which the plurality of pieces of divided travel condition information are connected to correspond to the railroad path network 19. The travel condition network information is herein network information including horizontal alignment of the railroad path network 19 as the travel condition network information includes the location information.

Processing illustrated in FIGS. 4 and 5 and processing illustrated in FIGS. 6 and 7 may separately be performed, and the travel condition network information including at least one of the information on the behavior of the transport and the information on the path during travel may be associated with the travel condition network information including the location information. They have similar network structures, and thus can be associated with each other even when separately generated. As another example, each of the pieces of travel condition data may include the location data in the processing illustrated in FIGS. 4 and 5, and each of the pieces of travel condition data may include at least one of the information on the behavior of the railroad car 10 and the information on the path during travel in the processing illustrated in FIGS. 6 and 7. In these cases, dividing, the check, and the like may be performed based on the location data and at least one of the information on the behavior of the railroad car 10 and the information on the path during travel.

According to the present embodiment, the plurality of pieces of divided travel condition information responsive to the divided travel paths obtained by dividing the plurality of travel paths can be generated based on the pieces of travel condition data of the transport, and the travel condition network information corresponding to the travel path network can easily be generated based on the plurality of pieces of divided travel condition information.

That is to say, it is envisioned that various pieces of data, such as the speed, the acceleration, vertical vibration, and horizontal vibration during travel, are acquired from the railroad cars 10 running on the railroad path network 19, and, based on the pieces of data, the state of the track is monitored. In this case, it is assumed that information on the railroad path network 19 is acquired in advance, and the various pieces of data are overlaid on the railroad path network 19 to be used for monitoring of the track. In the present embodiment, when various pieces of data responsive to travel conditions are acquired from the plurality of railroad cars 10, the travel condition network information can be generated from the acquired pieces of data even if the information on the railroad path network 19 is not acquired in advance. As described above, the travel condition network information can be generated as the railroad path network 19 itself, data in which the various pieces of data responsive to the travel conditions are linked to have a network structure corresponding to the railroad path network 19, or the like, so that the data can be used for monitoring of the state of the track. The travel condition network information can be generated by installing sensors and the like in the railroad cars 10, and collecting data from each of the sensors, and generation of the travel condition network information is relatively easy.

Each of the railroad cars 10 runs on the railroad path network 19 laid in advance along a fixed path, and diverges at a fixed junction. The travel condition network information corresponding to the railroad path network 19 can easily be generated based on output from the travel condition output unit 30 provided on each of the railroad cars 10 running on the railroad path network 19 as described above.

The plurality of pieces of divided travel condition information are pieces of information divided at the junctions of the plurality of travel paths, so that the travel condition network information can easily be generated by associating the plurality of pieces of divided travel condition information with one another.

As described above, each of the pieces of travel condition data may include the location information on the location of the transport (pieces of location data G1, G2, G3, and G4), and the travel condition network information may include the location information on the location of the railroad path network 19 as the travel path network. In this case, the travel condition network information can be grasped as the location information corresponding to the railroad path network 19.

As described above, each of the pieces of travel condition data may include at least one of the information on the behavior of the transport and the information on the path during travel (pieces of data F1, F2, F3, and F4), and the travel condition network information may be information including at least one of the information on the behavior of the transport and a condition on the path during travel. At least one of a condition on the behavior of the transport and the condition on the path during travel between nodes of the travel condition network information can thereby be grasped. The information is easily used for monitoring of the track.

When the above-mentioned configurations are combined, that is, when each of the pieces of travel condition data includes the location information on the location of the transport (pieces of location data G1, G2, G3, and G4) and at least one of the information on the behavior of the transport and the information on the path during travel (pieces of data F1, F2, F3, and F4), and the travel condition network information is the information including the location information and at least one of the information on the behavior of the transport and the condition on the path during travel, a running location and the information on the behavior of the transport and the information on the path during travel can be associated with each other to be more easily used for monitoring of the track. The information on the behavior of the transport and the information on the path during travel can be information associated with a distance from the location information, and are easily used for monitoring.

By updating, after generation of the travel condition network information, the generated travel condition network information based on a piece of travel condition data of the transport thereafter, the travel condition network information can be updated when a path is added, a division location is added, and the information on the behavior of the transport and the information on the path during travel are changed. In this case, pieces of divided travel condition information corresponding to the same divided path may be updated so that old data is updated with new data, or with a weighted average data in which the new data is more heavily weighted. Data determined to be statistically abnormal from past data may be exempt from the processing.

The controller 40 can generate the plurality of pieces of divided travel condition information responsive to the divided travel paths obtained by dividing the plurality of travel paths by applying the inferential model 52 generated by machine learning to each piece of travel condition data of the transport.

The transport may be a watercraft, an aircraft, a drone for delivery, and the like. The watercraft and the aircraft travel along fixed routes, so that routes separated by ports, division points, and the like determined by the fixed routes can be the divided travel paths. As for the drone for delivery, when it is envisioned that the drone for delivery is set to travel along an air route determined to some extent to have a drone base as an origin point or a waypoint, paths separated at the drone base and division points determined by the air route can be the divided travel paths. At each of the division points, each of the watercraft, the aircraft, and the drone for delivery stays some time, turns, and diverges. The divided travel paths can thus be generated from the plurality of travel paths as described above.

Configurations described in the above-mentioned embodiment and modifications can be combined with each other as appropriate unless any contradiction occurs.

As described above, the present description includes the invention according to the following aspects.

The first aspect is a travel condition network information generation system including: a travel condition output unit provided on a transport, and outputting a piece of travel condition data responsive to a travel condition of the transport; and a controller generating, based on a plurality of pieces of travel condition data, a plurality of pieces of divided travel condition information responsive to divided travel paths obtained by dividing a plurality of travel paths, and generating, based on the plurality of pieces of divided travel condition information, travel condition network information corresponding to a travel path network of the transport.

The plurality of pieces of divided travel condition information responsive to the divided travel paths obtained by dividing the plurality of travel paths can thereby be generated based on the pieces of travel condition data of the transport, and the travel condition network information corresponding to the travel path network can easily be generated based on the plurality of pieces of divided travel condition information.

The second aspect is the travel condition network information generation system according to the first aspect, wherein the transport is a railroad car, and, as processing of generating the travel condition network information corresponding to the travel path network, the controller performs processing of generating travel condition network information corresponding to a railroad path network of the railroad car.

The railroad car runs on the railroad path network laid in advance along a fixed path, and diverges at a fixed junction. The travel condition network information corresponding to the railroad path network can easily be generated based on output from the travel condition output unit provided on the railroad car running on the railroad path network as described above.

The third aspect is the travel condition network information generation system according to the first or the second aspect, wherein the plurality of pieces of divided travel condition information are pieces of information divided at junctions of the plurality of travel paths.

The plurality of pieces of divided travel condition information are the pieces of information divided at the junctions of the plurality of travel paths, so that the travel condition network information can easily be generated by associating the plurality of pieces of divided travel condition information with one another.

The fourth aspect is the travel condition network information generation system according to any one of the first to the third aspects, wherein each piece of travel condition data includes location information on a location of the transport, and the travel condition network information includes location information on a location of the travel path network.

The travel condition network information can thereby be grasped as the location information.

The fifth aspect is the travel condition network information generation system according to any one of the first to the fourth aspects, wherein each piece of travel condition data includes at least one of information on behavior of the transport and information on a path during travel, and the travel condition network information includes at least one of the information on the behavior of the transport and the information on the path during travel.

At least one of the information on the behavior of the transport and the condition on the path during travel can be included in the travel condition network information. At least one of a condition on the behavior of the transport and the condition on the path during travel between nodes of the travel condition network information can thereby be grasped.

The sixth aspect is the travel condition network information generation system according to any one of the first to the fifth aspects, wherein, after generating the travel condition network information, the controller updates the generated travel condition network information based on a piece of travel condition data of the transport.

The travel condition network information can thereby be updated when a path is added, a division location is added, and the information on the behavior of the transport and the information on the path during travel are changed.

The seventh aspect is the travel condition network information generation system according to any one of the first to the sixth aspects, wherein the controller generates the plurality of pieces of divided travel condition information responsive to the divided travel paths obtained by dividing the plurality of travel paths by applying an inferential model generated by machine learning to each piece of travel condition data of the transport.

The eighth aspect is a travel condition network information generation apparatus including: a travel condition data input unit receiving a plurality of pieces of travel condition data responsive to a travel condition of a transport; and a controller generating, based on the plurality of pieces of travel condition data, a plurality of pieces of divided travel condition information responsive to divided travel paths obtained by dividing a plurality of travel paths, and generating, based on the plurality of pieces of divided travel condition information, travel condition network information corresponding to a travel path network of the transport.

The ninth aspect is the travel condition network information generation apparatus according to the eighth aspect, wherein the transport is a railroad car, and, as processing of generating the travel condition network information corresponding to the travel path network, the controller performs processing of generating travel condition network information corresponding to a railroad path network of the railroad car.

The railroad car runs on a railroad track network laid in advance along a fixed path, and diverges at a fixed junction. The travel condition network information corresponding to the travel path network can easily be generated based on output from the travel condition output unit provided on the railroad car running on the railroad track network as described above.

The tenth aspect is the travel condition network information generation apparatus according to the eighth or the ninth aspect, wherein the plurality of pieces of divided travel condition information are pieces of information divided at junctions of the plurality of travel paths.

The plurality of pieces of divided travel condition information are the pieces of information divided at the junctions of the plurality of travel paths, so that the travel condition network information can easily be generated by associating the plurality of pieces of divided travel condition information with one another.

The eleventh aspect is the travel condition network information generation apparatus according to any one of the eighth to the tenth aspects, wherein each of the pieces of travel condition data includes location information on a location of the transport, and the travel condition network information includes location information on a location of the travel path network.

The travel condition network information can thereby be grasped as the location information.

The twelfth aspect is the travel condition network information generation apparatus according to any one of the eighth to the eleventh aspects, each of the pieces of travel condition data includes at least one of information on behavior of the transport and information on a path during travel, and the travel condition network information includes at least one of the information on the behavior of the transport and the information on the path during travel.

At least one of the information on the behavior of the transport and the condition on the path during travel can thereby be included in the travel condition network information. At least one of a condition on the behavior of the transport and the condition on the path during travel between nodes of the travel condition network information can thereby be grasped.

The thirteenth aspect is the travel condition network information generation apparatus according to any one of the eighth to the twelfth aspects, wherein, after generating the travel condition network information, the controller updates the generated travel condition network information based on a piece of travel condition data of the transport.

The fourteenth aspect is the travel condition network information generation apparatus according to any one of the eighth to the thirteenth aspects, wherein the controller generates the plurality of pieces of divided travel condition information responsive to the divided travel paths obtained by dividing the plurality of travel paths by applying an inferential model generated by machine learning to each of the pieces of travel condition data of the transport.

The plurality of pieces of divided travel condition information can thereby be generated by applying the inferential model generated by machine learning.

The fifteenth aspect is a travel condition network information generation method including: (a) outputting a plurality of pieces of travel condition data responsive to a travel condition of a transport; (b) generating, based on the plurality of pieces of travel condition data, a plurality of pieces of divided travel condition information responsive to divided travel paths obtained by dividing a plurality of travel paths; and (c) generating, based on the plurality of pieces of divided travel condition information, travel condition network information corresponding to a travel path network of the transport.

The plurality of pieces of divided travel condition information responsive to the divided travel paths obtained by dividing the plurality of travel paths can thereby be generated based on the pieces of travel condition data of the transport, and the travel condition network information corresponding to the travel path network can easily be generated based on the plurality of pieces of divided travel condition information.

The sixteenth aspect is the travel condition network information generation method according to the fifteenth aspect, wherein the step (a) is a step of outputting a plurality of pieces of travel condition data responsive to a travel condition of a railroad car as the transport, and the step (c) is a step of generating travel condition network information corresponding to a railroad path network of the railroad car.

The railroad car runs on a railroad track network laid in advance along a fixed path, and diverges at a fixed junction. The travel condition network information corresponding to the travel path network can easily be generated based on output from the travel condition output unit provided on the railroad car running on the railroad track network as described above.

The seventeenth aspect is the travel condition network information generation method according to the fifteenth or the sixteenth aspect, wherein the plurality of pieces of divided travel condition information are pieces of information divided at junctions of the plurality of travel paths.

The plurality of pieces of divided travel condition information are the pieces of information divided at the junctions of the plurality of travel paths, so that the travel condition network information can easily be generated by associating the plurality of pieces of divided travel condition information with one another.

The eighteenth aspect is the travel condition network information generation method according to any one of the fifteenth to the seventeenth aspects, wherein each of the pieces of travel condition data includes location information on a location of the transport, and the travel condition network information includes location information on a location of the travel path network.

The travel condition network information can thereby be grasped as the location information.

The nineteenth aspect is the travel condition network information generation method according to any one of the fifteenth to the eighteenth aspects, wherein each of the pieces of travel condition data includes at least one of information on behavior of the transport and information on a path during travel, and the travel condition network information includes at least one of the information on the behavior of the transport and the information on the path during travel.

At least one of the information on the behavior of the transport and the condition on the path during travel can thereby be included in the travel condition network information. At least one of a condition on the behavior of the transport and the condition on the path during travel between nodes of the travel condition network information can thereby be grasped.

The twentieth aspect is the travel condition network information generation method according to any one of the fifteenth to the nineteenth aspects, wherein, in the step (c), the generated travel condition network information is updated based on a piece of travel condition data of the transport and the generated travel condition network information.

The travel condition network information can thereby be updated when a path is added, a division location is added, and the information on the behavior of the transport and the information on the path during travel are changed.

While the present invention has been described in detail above, the foregoing description is in all aspects illustrative and does not restrict the present invention. It is understood that numerous modifications not having been described can be devised without departing from the scope of the present invention.

EXPLANATION OF REFERENCE SIGNS

10 transport (railroad car)
11 travel condition data
18 track
19 railroad path network
20 communication network
30 travel condition output unit
34 communication apparatus
40 controller
41 communication apparatus
42 operation unit
43 dividing processing unit
44 check processing unit
45 classification processing unit
46 first storage
48 second storage
52 inferential model
F1, F2, F2, F3 data (travel condition information)

F1(P2), F1(P4), F1(P5), F2(P1), F2(P3) . . . data (divided travel condition information)

G1, G2, G3, G4 data (travel condition information)

G1(P2), G1(P4), G1(P5), G2(P1), G2(P3) . . . location data (divided travel condition information)

M1, M2, M3, M4 travel path

N1, N2 travel condition network information

P1, P2, P3 . . . divided path

The invention claimed is:

1. A travel condition network information generation system comprising:

a travel condition output sensor provided on a transport, and outputting a piece of travel condition data responsive to a travel condition of the transport; and a controller generating a plurality of pieces of divided travel condition information responsive to divided travel paths obtained by dividing a plurality of travel paths, by dividing a plurality of pieces of travel condition data at junctions, and generating travel condition network information corresponding to a travel path network of the transport, by connecting the plurality of pieces of divided travel condition information, wherein the transport is a railroad car, and as processing of generating the travel condition network information corresponding to the travel path network, the controller performs processing of generating travel condition network information corresponding to a railroad path network of the railroad car, wherein the travel condition data includes at least one of information on vibration of the railroad car detected by speed or acceleration in the direction of travel of the railroad car or detected by an acceleration sensor or a gyroscopic sensor, or information in accordance with a surface condition or displacement condition of the track which is the path during travel, wherein travel condition data transmitted from a plurality of railroad cars is accumulated in a first storage as a travel condition database, wherein the controller generates the travel condition network information corresponding to the railroad path network of the plurality of railroad cars based on the travel condition database accumulated in the first storage, and wherein, during travel of the railroad car, the controller (i) generates the plurality of pieces of divided travel condition information responsive to the divided travel paths obtained from the plurality of railroad cars by dividing the plurality of travel paths by applying an inferential model generated by machine learning to each piece of travel condition data of the plurality of railroad cars, (ii) classifies each piece of the plurality of pieces of divided travel condition information into a plurality of classified units, (iii) integrates pieces of divided travel condition information having the same classified unit into a single piece of divided travel condition information, and (iv) connects the plurality of units of divided travel condition information after classification and integration to form a single railroad path network.

2. The travel condition network information generation system according to claim 1, wherein each piece of travel condition data includes location information on a location of the transport, and the travel condition network information includes location information on a location of the travel path network.

3. The travel condition network information generation system according to claim 1, wherein each piece of travel condition data includes at least one of information on behavior of the transport and information on a path during travel, and the travel condition network information includes at least one of the information on the behavior of the transport and the information on the path during travel.

4. The travel condition network information generation system according to claim 1, wherein after generating the travel condition network information, the controller updates the generated travel condition network information based on a piece of travel condition data of the transport.

5. A travel condition network information generation apparatus comprising:

a travel condition data input interface receiving a plurality of pieces of travel condition data responsive to a travel condition of a transport; and a controller generating a plurality of pieces of divided travel condition information responsive to divided travel paths obtained by dividing a plurality of travel paths, by dividing a plurality of pieces of travel condition data at junctions, and generating travel condition network information corresponding to a travel path network of the transport, by connecting the plurality of pieces of divided travel condition information, wherein the transport is a railroad car, and as processing of generating the travel condition network information corresponding to the travel path network, the controller performs processing of generating travel condition network information corresponding to a railroad path network of the railroad car, wherein the travel condition data includes at least one of information on vibration of the railroad car detected by speed or acceleration in the direction of travel of the railroad car or detected by an acceleration sensor or a gyroscopic sensor, or information in accordance with a surface condition or displacement condition of the track which is the path during travel, wherein travel condition data transmitted from a plurality of railroad cars is accumulated in a first storage as a travel condition database, wherein the controller generates the travel condition network information corresponding to the railroad path network of the plurality of railroad cars based on the travel condition database accumulated in the first storage, and wherein, during travel of the railroad car, the controller (i) generates the plurality of pieces of divided travel condition information responsive to the divided travel paths obtained from the plurality of railroad cars by dividing the plurality of travel paths by applying an inferential model generated by machine learning to each piece of travel condition data of the plurality of railroad cars, (ii) classifies each piece of the plurality of pieces of divided travel condition information into a plurality of classified units, (iii) integrates pieces of divided travel condition information having the same classified unit into a single piece of divided travel condition information, and (iv) connects the plurality of units of divided travel condition information after classification and integration to form a single railroad path network.

6. The travel condition network information generation apparatus according to claim 5, wherein each of the pieces of travel condition data includes location information on a location of the transport, and the travel condition network information includes location information on a location of the travel path network.

7. The travel condition network information generation apparatus according to claim 5, wherein each of the pieces of travel condition data includes at least one of information on behavior of the transport and information on a path during travel, and the travel condition network information includes at least one of the information on the behavior of the transport and the information on the path during travel.

8. The travel condition network information generation apparatus according to claim 5, wherein after generating the travel condition network information, the controller updates the generated travel condition network information based on a piece of travel condition data of the transport.

9. A travel condition network information generation method comprising:

(a) outputting a plurality of pieces of travel condition data responsive to a travel condition of a transport;

(b) generating a plurality of pieces of divided travel condition information responsive to divided travel paths obtained by dividing a plurality of travel paths, by dividing a plurality of pieces of travel condition data at junctions;

(c) generating travel condition network information corresponding to a travel path network of the transport, by connecting the plurality of pieces of divided travel condition information; and (d) accumulating travel condition data transmitted from a plurality of railroad cars in a first storage as a travel condition database, wherein the step (a) is a step of outputting a plurality of pieces of travel condition data responsive to a travel condition of a railroad car as the transport, and the step (c) is a step of generating travel condition network information corresponding to a railroad path network of the railroad car, wherein the travel condition data includes at least one of information on vibration of the railroad car detected by speed or acceleration in the direction of travel of the railroad car or detected by an acceleration sensor or a gyroscopic sensor, or information in accordance with a surface condition or displacement condition of the track which is the path during travel, wherein, in the step (c), the generated travel condition network information corresponding to the railroad path network of the plurality of railroad cars is based on the travel condition database accumulated in the first storage, and wherein, during travel of the railroad car (i) the plurality of pieces of divided travel condition information responsive to the divided travel paths obtained from the plurality of railroad cars are generated by dividing the plurality of travel paths by applying an inferential model generated by machine learning to each piece of travel condition data of the plurality of railroad cars, (ii) each piece of the plurality of pieces of divided travel condition information is classified into a plurality of classified units, (iii) pieces of divided travel condition information having the same classified unit are integrated into a single piece of divided travel condition information, and (iv) the plurality of units of divided travel condition information are connected after classification and integration to form a single railroad path network.

10. The travel condition network information generation method according to claim 9, wherein each of the pieces of travel condition data includes location information on a location of the transport, and the travel condition network information includes location information on a location of the travel path network.

11. The travel condition network information generation method according to claim 9, wherein each of the pieces of travel condition data includes at least one of information on behavior of the transport and information on a path during travel, and the travel condition network information includes at least one of the information on the behavior of the transport and the information on the path during travel.

12. The travel condition network information generation method according to claim 9, wherein in the step (c), the generated travel condition network information is updated based on a piece of travel condition data of the transport and the generated travel condition network information.

* * * * *